US006088928A

United States Patent [19]

Sugimoto

[11] Patent Number: 6,088,928

[45] Date of Patent: Jul. 18, 2000

[54] CLOTH DRYER FOR A WATER JET LOOM

[75] Inventor: Takao Sugimoto, Tokyo, Japan

[73] Assignee: Kabushiki Kaisha Toyoda Jidoshokki Seisakusho, Aichi-ken, Japan

[21] Appl. No.: 09/166,737

[22] Filed: Oct. 5, 1998

[30] Foreign Application Priority Data

Oct. 6, 1997 [JP] Japan ..... 9-273142
Sep. 28, 1998 [JP] Japan ..... 10-273795

[51] Int. Cl.[7] ..... F26B 9/04

[52] U.S. Cl. ..... 34/144; 34/624

[58] Field of Search ..... 34/143, 144, 624, 34/627, 628

[56] References Cited

U.S. PATENT DOCUMENTS 2,532,910 12/1950 Hayward ..... 34/68
3,246,400 4/1966 Brown ..... 34/110
5,174,046 12/1992 Chern ..... 34/115

*Primary Examiner*—Henry Bennett
*Assistant Examiner*—Malik N. Drake
*Attorney, Agent, or Firm*—Kanesaka & Takeuchi

[57] ABSTRACT

To reduce the heating temperature and electric power consumption, maintain the quality of cloth and thoroughly dry the cloth, the cloth is heated and dried while it travels over a press roller, is wound round a surface roller through a pressure contact portion, is guided to a pressure contact portion between the surface roller and the other press roller, and travels round the other press roller.

8 Claims, 9 Drawing Sheets

CLOTH DRYER FOR A WATER JET LOOM

BACKGROUND OF THE INVENTION

1. Field of the Invention

The present invention relates to a cloth dryer for drying moisture contained in cloth woven by a water jet loom on the loom.

2. Description of the Prior Art

Since cloth woven by a water jet loom contains water, when the cloth having a large moisture content is taken up by a cloth roller, the quality of the cloth may be lowered by the growth of mould or the like while it is kept. Therefore, a technology for drying the cloth on the loom is known.

As this type of technology, there is known one disclosed by Japanese Laid-open Utility Model No. 2-142484. This technology is to absorb and remove moisture contained in cloth by installing a hollow pipe having a slit formed in contact with the cloth between right and left side frames on a loom and supplying suction air flow from a blower into the hollow pipe. A blow-off pipe is installed between a surface roller and a cloth roller, exhaust air from the blower is supplied into this blow-off pipe, and a moisture percentage between the blow-off pipe and the cloth roller is detected to adjust the output of the blower.

Japanese Laid-open Patent Application No. 61-258050, for example, discloses an apparatus for controlling the amount of heat generated from an electric drying heat source according to the detection value of a moisture meter by installing the electric drying heat source for drying with a heater, hot air or the like and the moisture meter between a press roller and a cloth roller.

Further, Japanese Laid-open Utility Model No. 2-142485 discloses an apparatus for drying cloth by incorporating a rod-shaped electric heater in a wrinkle preventing roller arranged in wedge-shaped space between cloth taken up by a cloth roller and cloth to be wound.

In the technology disclosed by the above Japanese Laid-open Utility Model No. 2-142484, although the moisture percentage of cloth is detected to adjust the output of the blower, when the loom is operated at a high speed to increase production efficiency, cloth having a large moisture content such as thick cloth may not be dried completely simply by applying a suction air flow and an exhaust air flow to only a part in a winding direction of the woven cloth. In this case, the cloth must be dried thoroughly with a dryer using a heater in a post-step with a result of an increase in electric power consumption.

When the amount of heat generated from the electric drying heat source is controlled as in the technology disclosed by Japanese Laid-open Patent Application No. 61-258050, the electric drying heat source and the moisture meter are installed in relatively narrow space between the press roller and the cloth roller. Therefore, the installation space of the electric drying heat source is small and the cloth must be partially heated with a large amount of heat, whereby the shrinkage of the cloth is made uneven in the width direction of the cloth by locally heating the woven cloth having nonuniformity in moisture in the width direction of the cloth at a high temperature in a winding direction, the quality of the cloth is impaired, and electric power consumption is greatly increased uneconomically.

Further, when the electric heater is incorporated in the wrinkle preventing roller as in the technology disclosed by Japanese Laid-open Utility Model No. 2-142485, since the contact distance between the wrinkle preventing roller and the cloth is small, the cloth is partially heated in a winding direction of the cloth, the warp and weft of the heated part of the cloth are stretched with heat and pressed by the wrinkle prevention roller, the cross sections and intersections of the warp and weft are made flat, the resulting woven cloth has a shining feeling and does not give a voluminous impression, and the quality of the cloth is impaired.

SUMMARY OF THE INVENTION

It is an object of the present invention to provide a cloth dryer for a water jet loom which can reduce heating temperature, maintain the quality of cloth, reduce electric power consumption and dry the cloth thoroughly by extending the length of the cloth to be heated as much as possible.

According to a first aspect of the present invention, there is provided a cloth dryer for a water jet loom, which thermally dries moisture contained in cloth by bringing a roller incorporating heating means into contact with the cloth woven by the loom, wherein the woven cloth passes through pressure contact portions among a plurality of cloth winding rollers which are in pressure contact with one another and is wound off to a cloth roller side from at least one roller which the cloth is wound round out of the plurality of cloth winding rollers, and the heating means is incorporated in at least one roller out of the plurality of cloth winding rollers.

According to a second aspect of the present invention, there is provided a cloth dryer for a water jet loom wherein the heating means is located in the center or in the vicinity of the center of the roller.

According to a third aspect of the present invention, there is provided a cloth dryer for a water jet loom wherein the roller incorporating the heating means is a surface roller which is rotated supported by the right and left side frame of the water jet loom.

According to a fourth aspect of the present invention, there is provided a cloth dryer for a water jet loom wherein moisture condensation preventing means for preventing moisture condensation on upper peripheral members is provided above the roller incorporating the heating means.

According to a fifth aspect of the present invention, there is provided a cloth dryer for a water jet loom wherein the moisture condensation means is means, located in space above the roller incorporating the heating means, for generating an air flow going toward the width direction of the cloth.

According to a sixth aspect of the present invention, there is provided a cloth dryer for a water jet loom wherein the amount of heat input into the roller by the heating means is made larger at the end portions than the center portion in a width direction of the cloth.

According to a seventh aspect of the present invention, there is provided a cloth dryer for a water jet loom wherein, the heating means is a coiled electric heater which is supported by a rod member extending in an axial direction of the roller.

According to an eighth aspect of the present invention, there is provided a cloth dryer for a water jet loom wherein, the heating means comprises means of controlling preheating temperature to a temperature lower than drying temperature in response to a loom stop signal.

The above and other objects, features and advantages of the invention will become more apparent from the following description when taken in conjunction with the accompanying drawings.

BRIEF DESCRIPTION OF THE ACCOMPANYING DRAWINGS

Figure 6:
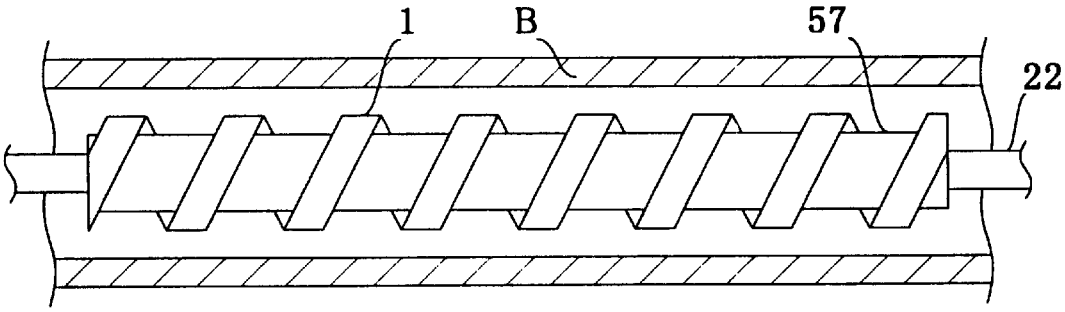
Figure 7:
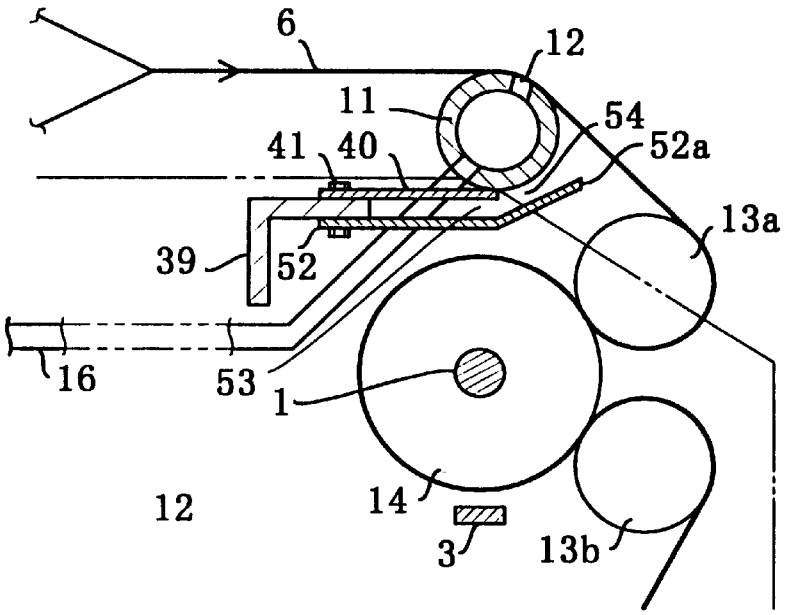
Figure 8:
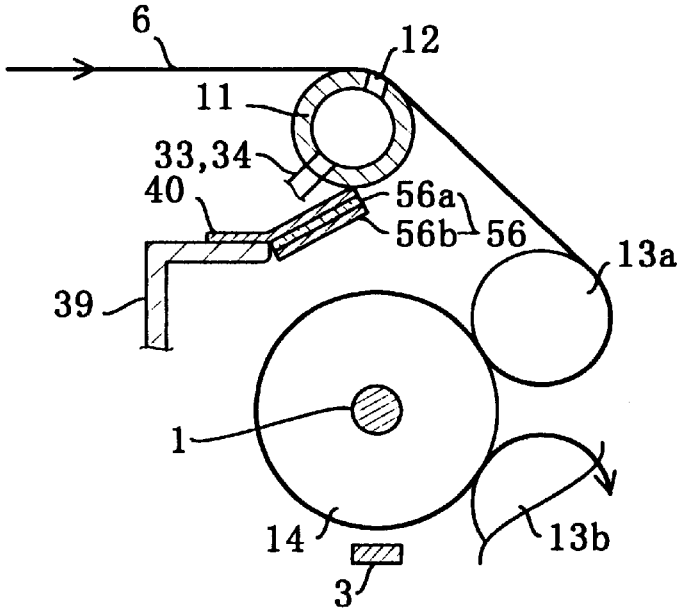
Figure 9:
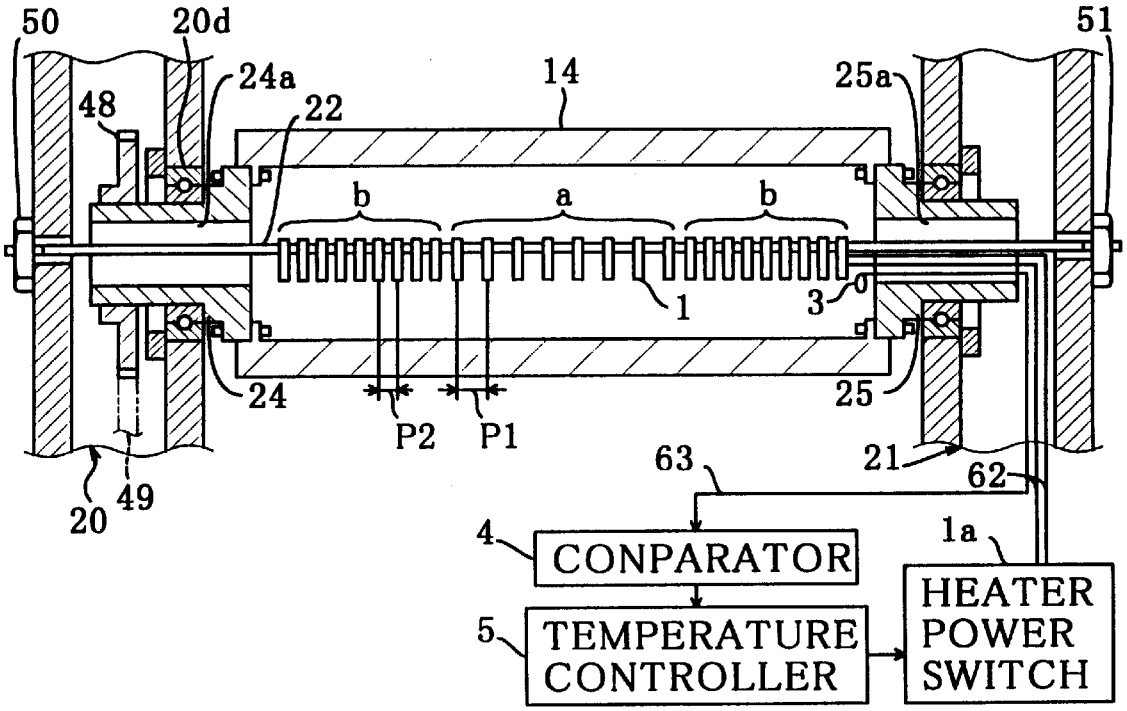
Figure 10:
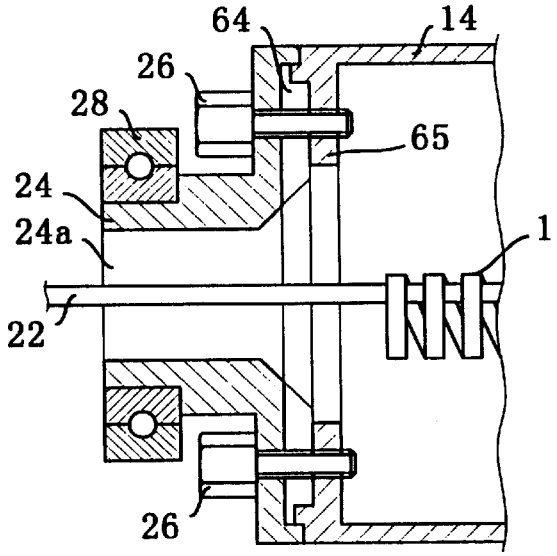
Figure 11:
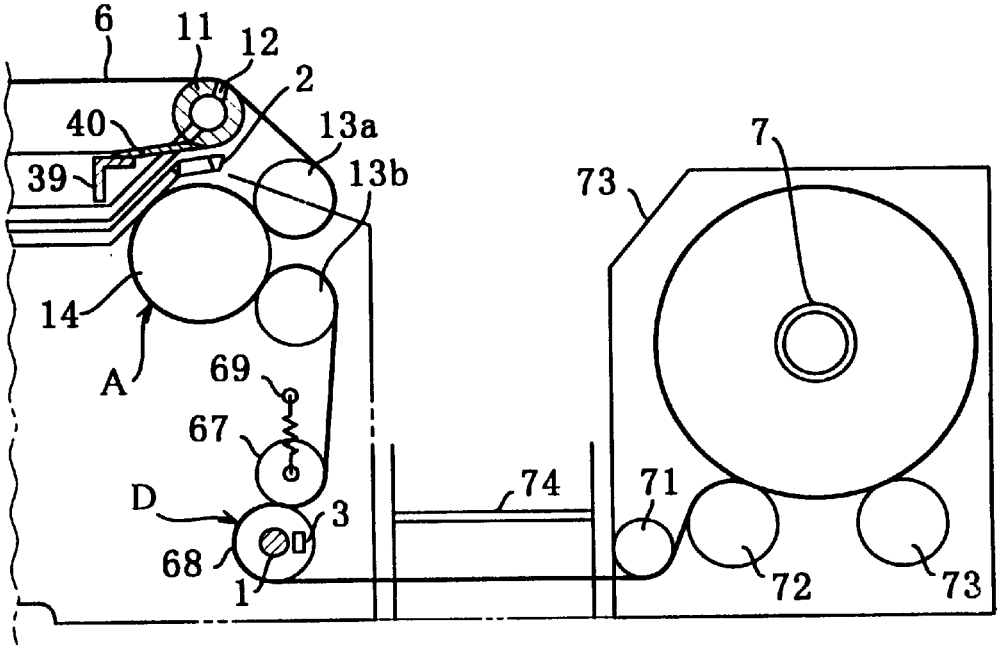
Figure 12A:
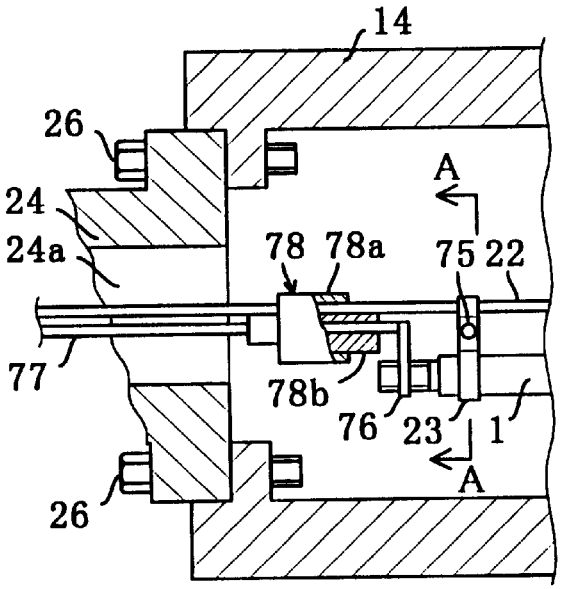
Figure 12B:
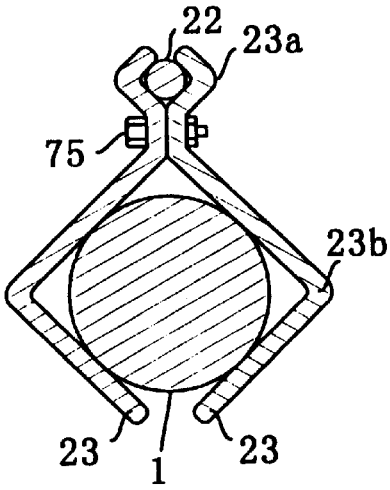
Figure 13A:
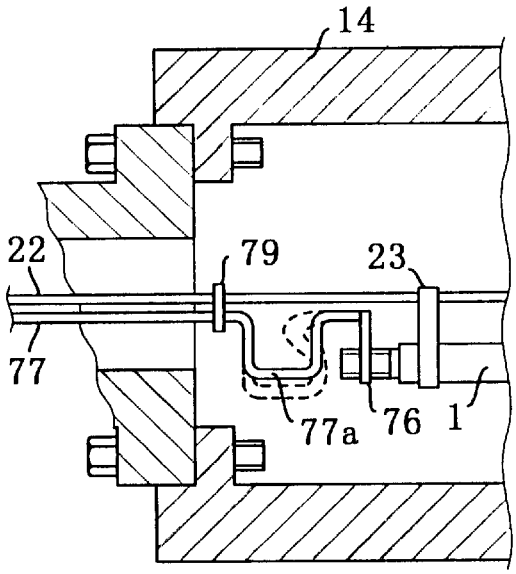
Figure 13B:
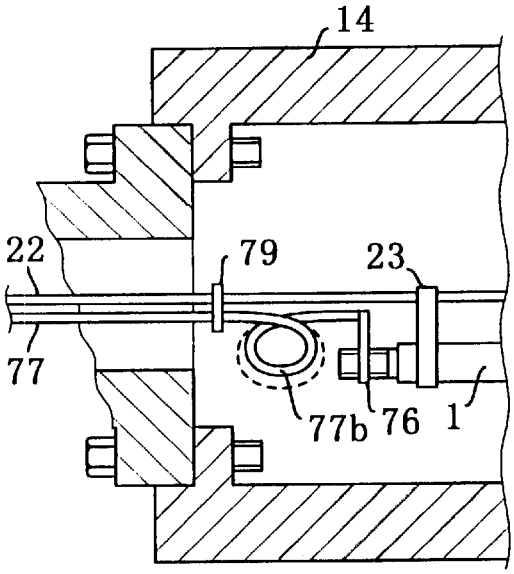
Figure 14:
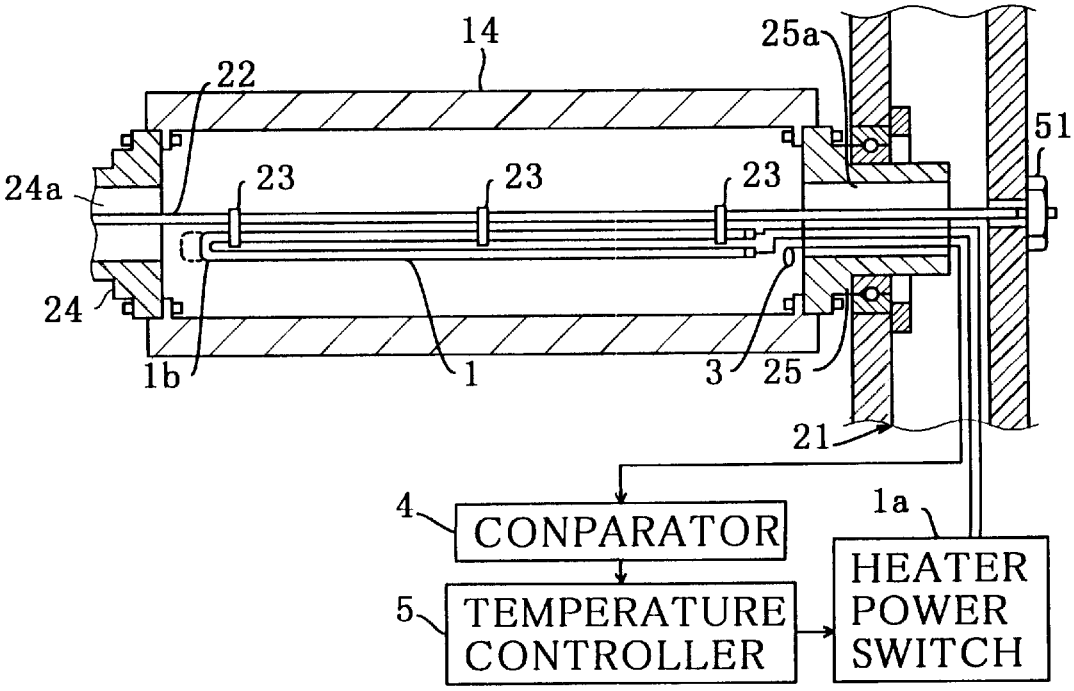
Figure 15:
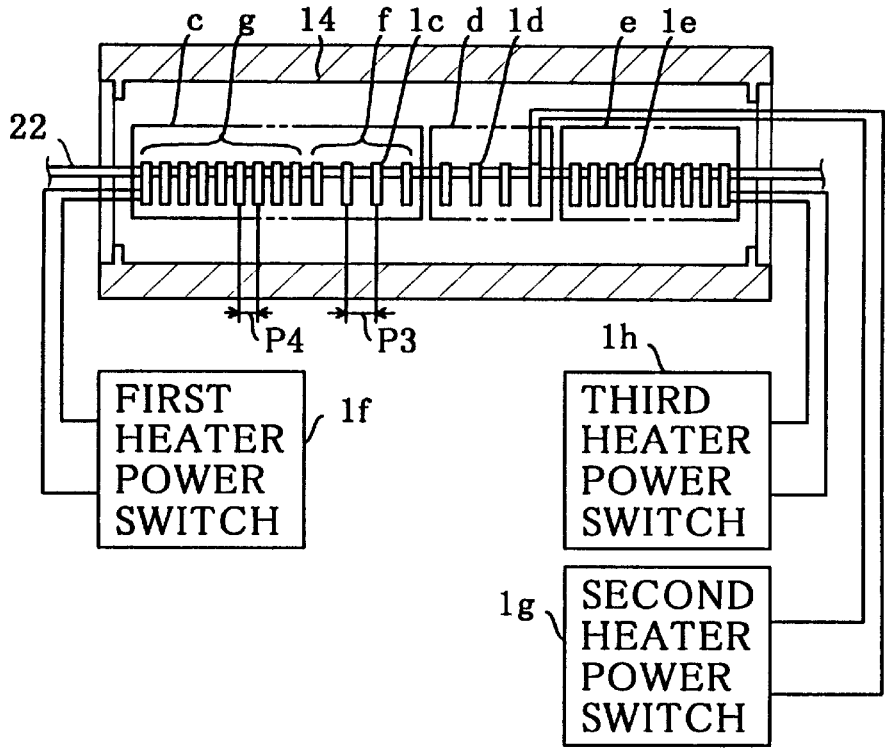
Figure 16:
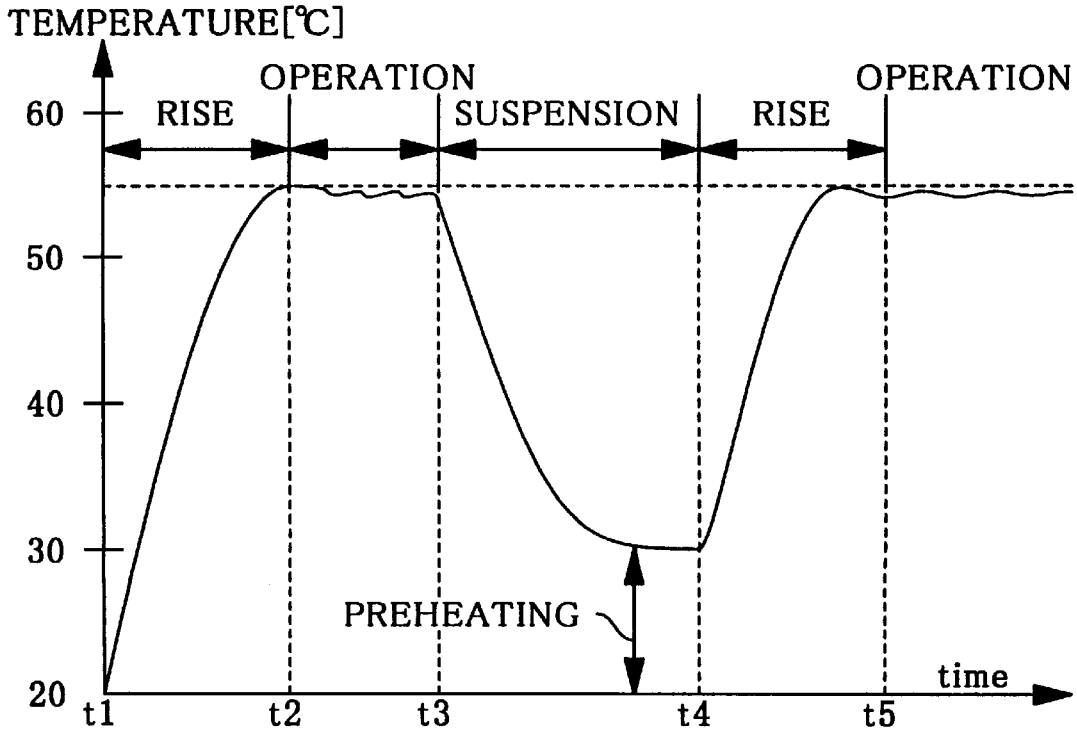

FIGS. 5(*a*) and 5(*b*) are sectional views of a second embodiment of the present invention;

FIG. 6 is a sectional view of a third embodiment of the present invention;

FIG. 7 is a sectional view of a fourth embodiment of the present invention;

FIG. 8 is a sectional view of a fifth embodiment of the present invention;

FIG. 9 is a sectional view of a seventh embodiment of the present invention;

FIG. 10 is a sectional view of an eighth embodiment of the present invention;

FIG. 11 is a sectional view of a ninth embodiment of the present invention;

FIG. 12 is a sectional view of a tenth embodiment of the present invention;

FIG. 13(*a*) is a sectional view in an axial direction of an eleventh embodiment of the present invention and FIG. 13(*b*) is a sectional view cut on line A—A of FIG. 13(*a*);

FIG. 14 is a sectional view of a twelfth embodiment of the present invention;

FIG. 15 is a sectional view of a thirteenth embodiment of the present invention; and FIG. 16 is a graph showing temperature variations in a fourteenth embodiment of the present invention.

DETAILED DESCRIPTION OF THE PREFERRED EMBODIMENTS

First Embodiment

Figure 1:
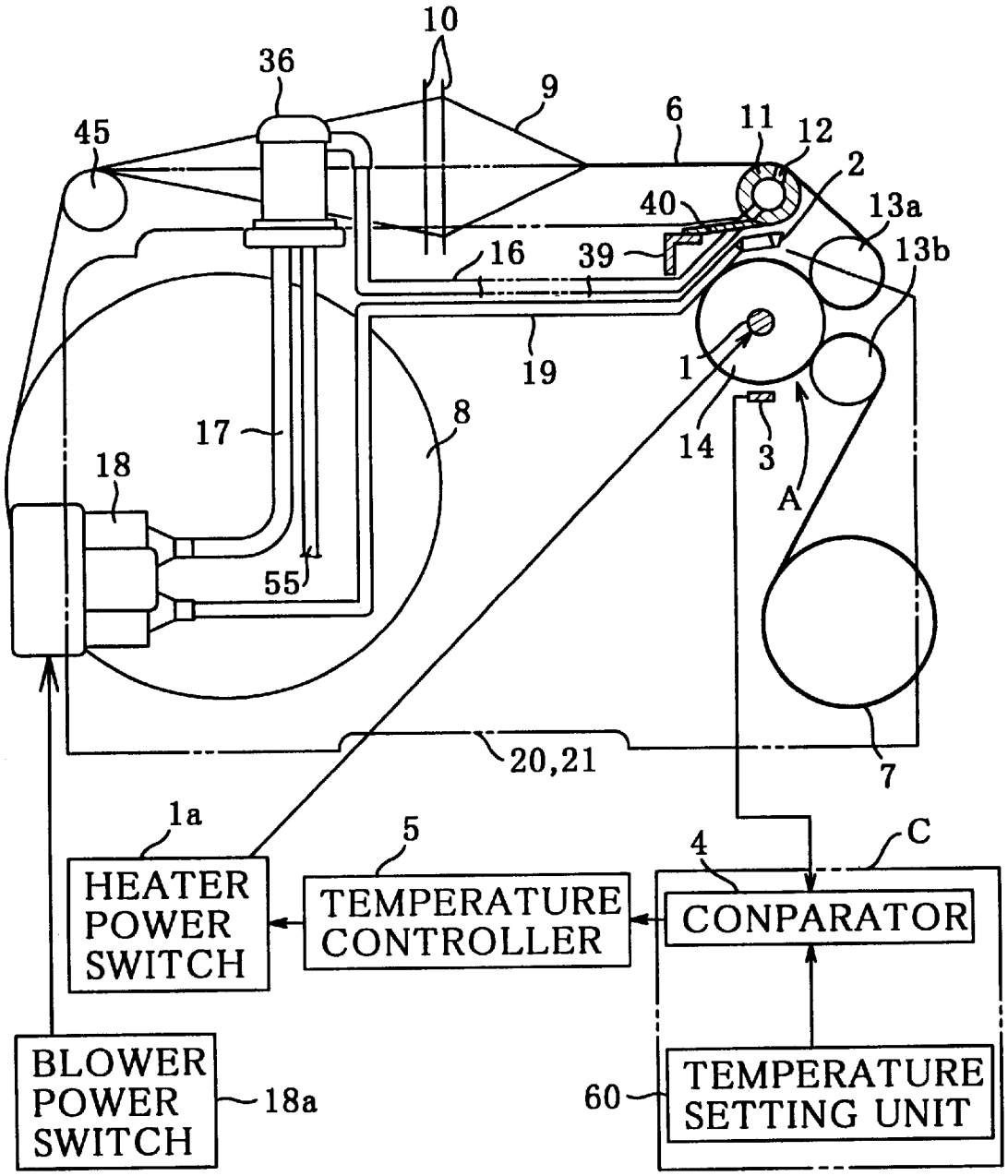
FIG. 1 is a block diagram of a first embodiment of the present invention when seen from the side.
Figure 2:
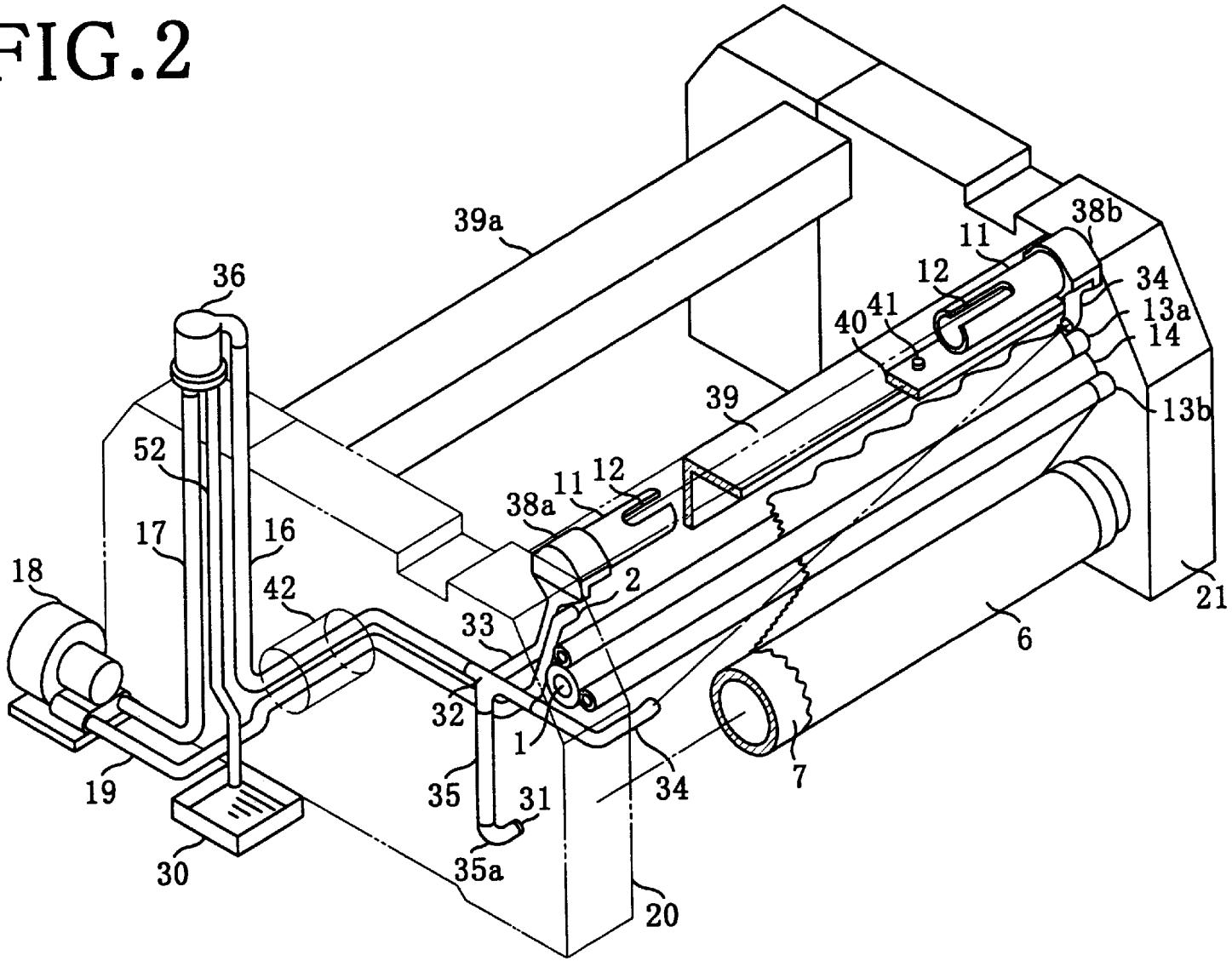
FIG. 2 is a perspective view of the assembly of the first embodiment.
Figure 3:
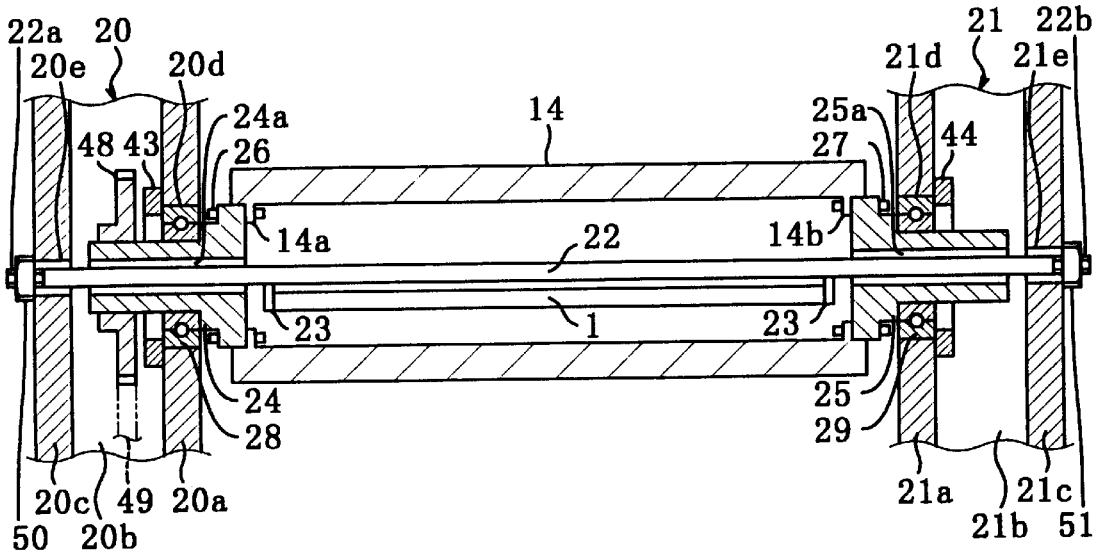
FIG. 3 is a sectional view of key parts of the first embodiment.
Figure 4:
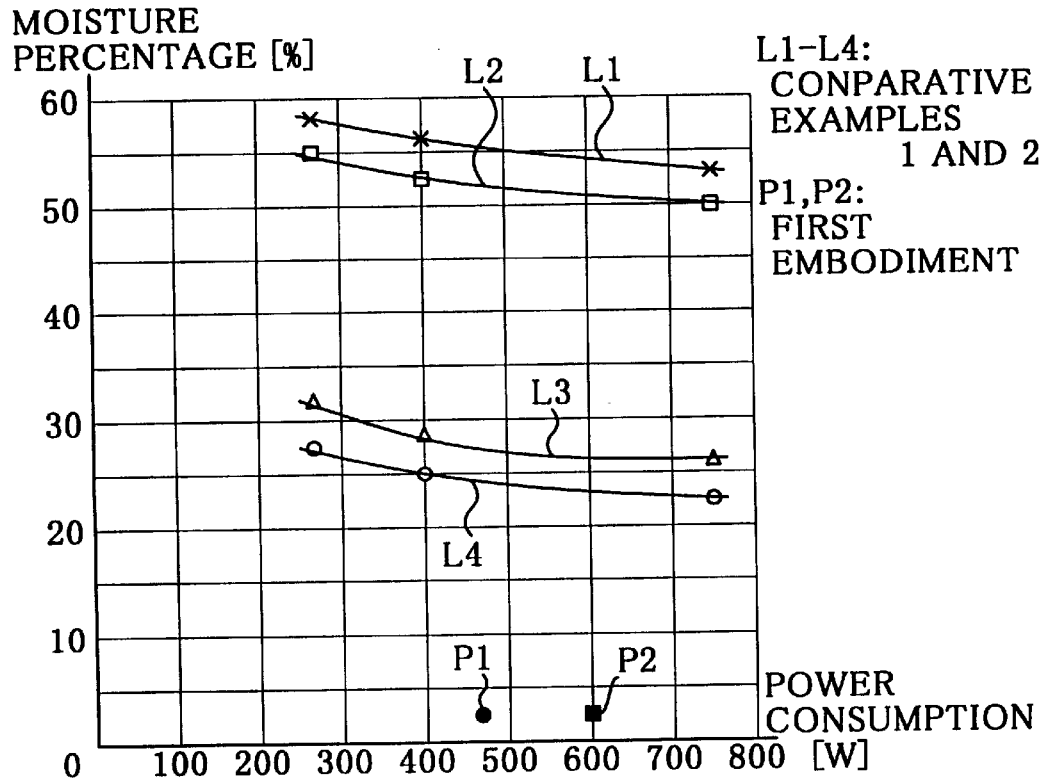
FIG. 4 is a graph showing the results of experiments on the first embodiment.

FIGS. 1 to 4 show a first embodiment of the present invention. FIG. 1 is a block diagram of a cloth dryer, FIG. 2 is a perspective view of the installation of the cloth dryer relative to a skeleton unit composed of right and left side frames 20, 21 and a top stay 39 of a water jet loom, FIG. 3 is a sectional view cut in an axial direction of the assembly of an electric heater 1, a surface roller 14 and the like relative to the right and left side frames 20, 21, and FIG. 4 is a graph showing the results of cloth drying experiments on the first embodiment and comparative examples.

First referring to FIG. 1, reference numeral 1 denotes a long rod-shaped electric heater which extends in a vertical direction of the paper of the drawing and is incorporated in one of a plurality of cloth winding rollers A consisting of 2 press rollers 13*a*, 13*b* and one surface roller 14. In this embodiment, as shown in FIG. 3, the electric heater 1 is stored substantially in the center portion of the surface roller 14 in such a manner that it is suspended in a substantially entire width direction of the cloth 6 travelling round the surface roller 14. Therefore, the electric heater 1 is electric heating means which generates heat with electricity supplied from an unshown power source through a temperature controller 5 and an unshown breaker to heat the entire peripheral surface of the surface roller 14 uniformly and efficiently when a heater power switch 1*a* shown in FIG. 1 is turned on. As the electric heater 1 may be used a far infrared type electric heater which makes use of the radiant heat of a resistance heat generating element made from nichrome and ceramic, a sheath type electric heater which makes use of the radiant heat of a resistance heat generating element whose core wire made from nichrome and mica is coated with a metal, an electromagnetic induction type electric heater which makes use of induction heat radiating electromagnetic waves due to an electromagnetic induction function, or the like.

Since the surface roller 14 heated by this electric heater 1 is in pressure contact with the press rollers 13*a*, 13*b*, the press rollers 13*a*, 13*b* are uniformly and wholly heated with heat transmitted from the surface roller 14. The cloth 6 is let off and passes over the plurality of cloth winding rollers A in such a manner that after it goes half round the upper press roller 13*a* and substantially 4/5 round the surface roller 14 through the contact plane between the press roller 13*a* and the surface roller 14, it goes half round the press roller 13*b* through the contact plane between the surface roller 14 and the lower press roller 13*b*. Thereby, the length of the cloth heated is extremely long and equal to the total distance of half the circumference of the press roller 13*a*, 4/5 the circumference of the surface roller 14 and half the circumference of the press roller 13*b*, thereby making it possible to reduce the heating temperature of the electric heater 1. In addition, the cloth 6 is laid on the press rollers 13*a*, 13*b* and the surface roller 14 to be heated in a wide range, thereby making it possible to reduce the heating temperature of the cloth 6 made of nylon or polyester to ca. 60° C. or lower which has no bad influence on the cloth 6. Therefore, even when cloth having a large moisture content such as thick cloth is woven by operating the loom at a high speed to increase production efficiency; a bulky drying apparatus for a post-step is not required, the quality of cloth can be maintained and electric power consumption can be reduced with an inexpensive apparatus. Since the surface roller 14 is a drive roller which has a larger diameter than the press rollers 13*a*, 13*b* and is fixed to the side frames 20, 21 and the electric heater 1 is incorporated in the surface roller 14, the cloth 6 is brought into contact with a heat source incorporated in a surface roller 14 having the highest temperature out of the plurality of cloth winding rollers without impairing operationability which occurs at the time of exchanging a warp beam with the result of further increased drying efficiency compared with the case where a support unit (not shown) is incorporated in the movable press rollers 13*a*, 13*b* to release their pressure contact with the surface roller 14 at the time of exchanging a warp beam. Since the outer peripheral surface of the surface roller 14 is made uneven to achieve appropriate friction force with the cloth 6 by sintering a mixture of aluminum particles and glass particles or rubber on the outer peripheral surface of an iron pipe or sandblasting the outer peripheral surface of a stainless steel pipe, water present in the texture of the cloth 6 is evaporated while it is pressed out with the uneven surface, thereby further increasing drying efficiency.

Reference numeral 3 denotes a temperature sensor as temperature detection means, located inside the surface roller 14, though it is depicted to be located outside the surface roller 14 in FIG. 1 for convenience's sake, for detecting temperature and outputting a converted electric signal as a detection temperature to a comparator 4.

Denoted by 60 is a temperature setting unit which sets a temperature suitable for drying according to drying conditions such as type of cloth, ambient temperature and humidity by the operation of an unshown loom operation board and outputs a converted electric signal as a set temperature to the comparator 4. The temperature setting unit 60 may enable an operator to input a set temperature directly. Alternatively, appropriate drying condition information equivalent to a plurality of drying conditions may be determined and stored in an unshown memory so that drying conditions at each time is input by the operation of the unshown loom operation to select corresponding drying condition information from the memory.

The comparator 4 compares the detection temperature from the temperature sensor 3 with the set temperature from the temperature setting unit 60 and outputs a converted electric signal indicative of the difference between the temperatures to the temperature controller 5. The temperature controller 5 supplies electric power corresponding to the temperature difference from the comparator 4 to the electric heater 1 through the heater power switch 1*a* which is turned on. That is, when the heater power switch 1*a* is turned on, the electric heater 1 is supplied with electric power corresponding to the temperature difference between the detection temperature and the set temperature by feedback control and heats the surface roller 14 to maintain the set temperature. The set temperature may be a value specified by the temperature setting unit 60 or a range of from an upper limit to a lower limit of the set temperature specified by the temperature setting unit 60. The comparator 4 and the temperature controller 5 are installed in a loom controller C. When the temperature sensor 3 is replaced by a heat sensitive element such as a bimetal heat sensitive element, thermostat or a gas filled type heat sensitive element which is turned on or off by the expansion and contraction of filled gas according to temperature, a feedback temperature control system consisting of the temperature sensor 3, the comparator 4, the temperature controller 5 and the temperature setting unit 60 can be eliminated and the temperature of the surface roller 14 can be open loop controlled by turning on and off electricity to the electric heater 1 according to temperature set in the heat sensitive element. The heater power switch 1*a* is set such that it cuts power when the loom is stopped.

Reference numeral 2 denotes a blow-off unit for blowing off exhaust air supplied from a blower 18 through a pipe 19. This exhaust blow-off unit 2 is moisture condensation preventing means for preventing moisture condensation on a dehydrating cylinder 11 and a water shielding plate 40 in such a manner that, on an inner side of the side frame 20 on a weft insertion side, a blow-off opening is located on the side of the dehydrating cylinder 11 and the water shielding plate 40 in space formed by the dehydrating cylinder 11, the surface roller 14 and the water shielding plate 40 forming air flow dehydrating means, exhaust air blown off from the blower 18 through the blow-off unit 2 generates an air flow going from the weft insertion side to its opposite side (cloth width direction) in space surrounded by the cloth 6 stretched on the dehydrating cylinder 11 and the upper press roller 13*a*, the dehydrating cylinder 11, the press rollers 13*a*, 13*b*, the surface roller 14, the water shielding plate 40 and the top stay 39, and vapor from the cloth 6 is discharged from the above space by this air flow.

The water shielding plate 40 is a belt-like plate for substantially covering space between the right and left side frames 20, 21, one end thereof is fixed to the top of the top stay 39 by a bolt and nut 41 (see FIG. 2), and the other end is in contact with a lower portion of the outer peripheral surface of the dehydrating cylinder 11. This water shielding plate 40 functions to shut off water by preventing weft insertion water jetted from an unshown weft insertion nozzle from being urged by an unshown reed to reach the press rollers 13*a*, 13*b* and the surface roller 14 from space between the dehydrating cylinder 11 and the top stay 39 so that the cloth 6 of that portion is not wet. Tapping water or under ground water is generally used as the above weft insertion water.

The dehydrating cylinder 11 is a hollow cylinder arranged between the side frames 20, 21 and having a slit 12 formed in a portion in contact with the cloth 6 in the same direction as a weft insertion direction. The suction function of the blower 18 is distributed to a first pipe 33 and a second pipe 34 shown in FIG. 2 through a pipe 17, a separator 36 and a pipe 16 and reaches both side end portions of the dehydrating cylinder 11 to suck air from the slit 12 through the cloth 6, whereby moisture contained in the cloth 6 is sucked along the entire width of the cloth 6 efficiently.

During the operation of the water jet loom, heat or vapor having high humidity rising from the surface roller 14 heated by the electric heater 1 contacts the under surface of the water shielding plate 40 or the outer peripheral surface of the dehydrating cylinder 11 maintained at a low temperature by cooling with weft insertion water or the like, moisture contained in the vapor or moisture contained in surrounding air is condensed, the condensed water gathers into a water drop by vibration during operation, and the water drop may fall on the cloth 6 on the surface roller 14. However, the cloth 6 on the surface roller 14 has been dehydrated by the dehydrating cylinder 11 and is being dehydrated by the press roller 13*a* and the surface roller 14. Therefore, a portion which has got wet with dropping water and other portions of the cloth 6 are dried differently with the result of the formation of dry spots. Due to the dry spots, dye spots are formed in the dyeing step.

To cope with this problem, an air flow generated by exhaust air blown off from the blow-off unit 2 blows vapor or heat rising from the surface roller 14 toward a side opposite to the weft insertion side from the weft insertion side, and the air flow reaching the opposite side goes to the outside through space between the side frame 21 and the cloth 6 on the opposite side, thereby preventing moisture condensation on the under surface of the water shielding plate 40 and the outer peripheral surface of the dehydrating cylinder 11.

As shown in FIG. 2, the separator 36 is an air/water separator which separates air from water flowing in from both end portions of the dehydrating cylinder 11 through the first pipe 33, the second pipe 34, the branch pipe 32 and the pipe 16, discharges the water into a water receiving box 30 shown in FIG. 2 from a pipe 55 and guides the air to the blower 18.

Reference numeral 8 shown in FIG. 1 denotes a warp beam, and a warp 9 wound round the warp beam 8 reaches a heald 10 through a guide roller 45 during the operation of the loom. The cloth 6 is woven of the warp 9 and an unshown weft by opening and closing by the heald 10, inserting the weft from a weft insertion nozzle and beating up with the unshown reed. After the cloth 6 goes over the dehydrating cylinder 11 and half round the upper press roller 13*a*, it passes through the contact plane between the press roller 13*a* and the surface roller 14 incorporating the electric heater 1 and is wound round the surface roller 14 more than half the circumference of the surface roller 14. The cloth 6 is further guided into the contact plane between the surface roller 14 and the lower press roller 13*b*, travels half round the press roller 13*b* and is taken up by a cloth roller 7. Reference symbol 18*a* denotes a blower power switch which supplies electricity to the blower 18 from an unshown power source to drive the blower 18 when it is turned and shuts off electricity to stop the blower 18 when it is turned off.

Next referring to FIG. 2, the unshown weft insertion nozzle is formed in the side frame 20 on the weft insertion side (left side in the figure). Dehydrating cylinder brackets 38*a*, 38*b* are provided for the left and right side frames 20, 21 to seal and fix both end portions of the dehydrating cylinder 11 arranged in parallel to the top stay 39, and the first pipe 33 and the second pipe 34 are separately connected to the both end portions, respectively. Further, an intermediate portion of the pipe 16 and an intermediate portion of the pipe 19 are connected to the inside and the outside of the side frame 20 through a through hole 42 formed in the side frame 20 on the weft insertion side (left side in the figure), whereby a half portion of the pipe 16, the pipe 17, the blower 18, a half portion of the pipe 19, the separator 36, the pipe 55 and the water receiving box 30 are arranged external to the side frame 20 on the weft insertion side, and the other half portion of the pipe 16, the other half portion of the pipe 19, the blow-off unit 2, the branch pipe 32, the first pipe 33, the second pipe 34, the pipe 35, an elbow 35*a* and a valve 31 are arranged internal to the side frame 20 on the weft insertion side.

The second pipe 34 is inclined downward to the weft insertion side from its opposite side (right side in the figure), moisture present inside the second pipe 34 in the form of mist changes into a water drop after the operation of the loom is stopped, and the water drop falls into the inside of the second pipe 34 and is discharged from the valve 31 through the pipe 35 and the elbow 35*a*. This prevents the water drop from entering the separator 36 at the time of the start of the loom and flowing into the blower 18 directly.

Further, since the first pipe 33 and the second pipe 34 which branch off from the blower 18 are connected to both end portions of the dehydrating cylinder 11 in this embodiment, suction force from the silt 12 is equal on both sides of the dehydrating cylinder 11 and can reduce non-uniformity in dehydration. An increase in the area of the passage from the blower 18 to the dehydrating cylinder 11 reduces suction resistance, thereby improving dehydrating efficiency. Since suction resistance in the pipe reduces, the load of the blower 18 is reduced and the exhaust air blow-off efficiency of the blow-off unit 2 is increased, thereby improving moisture condensation prevention efficiency.

Further referring to FIG. 3, reference numeral 22 denotes a heater stay made of a steel wire, for example, which is longer than the outer width from the left side frame 20 to the right side frame 21, male screw portions 22*a*, 22*b* are formed at both end portions thereof, and the electric heater 1 is fixed to an intermediate portion thereof by a plurality of heater brackets 23, 23 in such a manner that it is electrically insulated. Denoted by 24, 25 are roller shafts at both end portions of the surface roller 14, and through holes 24*a*, 25*a* are formed in center portions thereof, respectively. Since the mechanical strength of the roller shafts 24, 25 decreases when the through holes 24*a*, 25*a* are formed large in size, the size of the through holes 24*a*, 25*a* is determined such that an unshown cable for the electric heater 1 and the heater stay 22 can be inserted without interfering each other, thereby ensuring the rigidity of the roller shafts 24, 25. Therefore, as a portion where the electric heater 1 is fixed of the heater stay 22 cannot go through the through holes 24*a*, 25*a*, before the roller shafts 24, 25 are attached to the surface roller 14, the heater stay 22 is inserted from one end of the surface roller 14 to store the electric heater 1 inside the surface roller 14, and the cable of the electric heater 1 is pulled out to the outside from the through hole 25*a* in the other roller shaft 25. The roller shafts 24, 25 are then attached to both end portions of the surface roller 14. Both end portions of the heater stay 22 projecting outward from the surface roller 14 are inserted into the through holes 24*a*, 25*a*, and large diameter portions of the roller shafts 24, 25 are fitted into end portions of the surface roller 14. Bolts 26, 27 are fastened to support portions 14*a*, 14*b* provided inside the surface roller 14 from the outsides of the large diameter portions of the roller shafts 24, 25 to fix the roller shafts 24, 25 to both end portions of the surface roller 14, respectively. Although the heater brackets 23, 23 are provided at both end portions of the electric heater 1, the number of the heater brackets 23, 23 may be increased and the intermediate portion of the electric heater 1 may be fixed to the heater stay 22 by the heater brackets 23.

The side frames 20, 21 comprise frame bodies 20*a*, 21*a* as skeleton units on the surface roller 14 side and covers 20*c*, 21*c* placed upon these to form internal spaces 20*b*, 21*b* external to the frame bodies 20*a*, 21*a*, respectively. Storage hole portions 20*d*, 21*d* are formed in the frame bodies 20*a*, 21*a* coaxial to the axial core of the surface roller 14, and insertion holes 20*e*, 21*e* are formed in the covers 20*c*, 21*c* coaxial to the storage hole portions 20*d*, 21*d*, respectively. When the covers 20*c*, 21*c* are removed, a structure consisting of the electric heater 1, the heater stay 22, the heater brackets 23, 23, the surface roller 14 and the roller shafts 24, 25 is attached to the frame bodies 20*a*, 21*a*.

In other words, one end portion in an axial direction of the above structure is inserted into the storage hole portion 20*d* of one frame body 20*a* from inside and the other end portion of the structure is inserted into the storage hole portion 21*d* of the other frame body 21*a* from inside. After bearings 28, 29 are fitted into the storage hole portions 20*d*, 21*d* of the frame bodies 20*a*, 21*a* and small diameter portions of the roller shafts 24, 25, annular brackets 43, 44 are fastened to the outer sides of the frame bodies 20*a*, 21*a* around the storage hole portions 20*d*, 21*d* by unshown bolts, respectively, whereby inner peripheral portions of the brackets 43, 44 prevent the bearings 28, 29 from slipping out and the surface roller 14 from moving in an axial direction, respectively.

A shaft drive gear 48 is fitted onto the small diameter portion of the roller shaft 24 projecting outward from the frame body 20*a* and a loom main shaft side gear 49 shown by a virtual line is engaged with the shaft drive gear 48, whereby the surface roller 14 is rotated together with the unshown main shaft of the loom. Thereafter, both end portions of the heater stay 22 projecting outward from the roller shafts 24, 25 are inserted into the insertion holes 20*e*, 21*e* of the covers 20*c*, 21*c*, the covers 20*c*, 21*c* are fastened to the frame bodies 20*a*, 21*a* by unshown bolts separately in such a manner that they do not interfere the unshown cable of the electric heater 1 pulled out from the structure, nuts 50, 51 are fastened to the male screw portions 22*a*, 22*b* of the heater stay 22 projecting outward from the covers 20*c*, 21*c*, respectively, the heat stay 22 is thereby pulled to both sides to be straightened and stretched coaxial to the surface roller 14, and the electric heater 1 is arranged substantially in the center of the surface roller 14. Before the other cover 21*c* is fastened to the frame body 21*a* by an unshown bolt, the unshown cable of the structure is connected to the heater power switch 1*a* on the loom operation board side or pulled to the outside from an unshown wire pull-out hole formed in the side frame 21 and connected to the heater power switch 1*a* after the cover 21 is fastened.

Since the surface roller 14 incorporating the electric heater 1 is attached to the side frames 20, 21 as described above, the electric heater 1 and the surface roller 14 can be easily exchanged in the reverse order. In FIG. 3, the internal spaces 20*b*, 21*b* of the side frames 20, 21 are drawn smaller in size than the width actually required to install the structure.

Further referring to FIG. 4, the results of experiments on the drying of cloth in the first embodiment and Comparative Examples 1 and 2 will be described. In the first embodiment, first dehydration with the dehydrating cylinder 11 and second dehydration with the surface roller 14 incorporating the electric heater 1 were carried out. In Comparative Example 1, dehydration with the dehydrating cylinder 11 alone, that is, one-side dehydration that suction was carried out at one of both end portions in a longitudinal direction of the dehydrating cylinder 11 was carried out. In Comparative Example 2, dehydration with the dehydrating cylinder 11 alone shown in the first embodiment, that is, both-side dehydration that suction was carried out from the first pipe 33 and the second pipe 34 shown in FIG. 2 at both end portions in a longitudinal direction of the dehydrating cylinder 11 was carried out.

That is, FIG. 4 shows power consumption on the axis of abscissa and the moisture percentage of cloth on the axis of ordinates. A curve L1 shows the results of the experiments on Comparative Example 1 in which one-side dehydration was carried out on thick cloth, a curve L2 shows the results of the experiments on Comparative Example 2 in which both-side dehydration was carried out on thick cloth, a curve L3 shows the results of the experiments on Comparative Example 1 in which one-side dehydration was carried out on thin cloth, and a curve L4 shows the results of the experiments on Comparative Example 2 in which both-side dehydration was carried out on thin cloth. In the experiments on the first embodiment, when the power consumption was set to 480 W for thin cloth (the power consumption of the blower 18 was 280 W and the power consumption of the electric heater 1 was 200 W) and 600 W for thick cloth (the power consumption of the blower 18 was 280 W and the power consumption of the electric heater 1 was 320 W), the moisture percentage of cloth was 3% almost equal to that in a natural state. Therefore, experiments on the drying of cloth by changing power consumption were not conducted. A point P1 is plotted for thin cloth and P2 for thick cloth as the results of the experiments on the first embodiment.

In view of FIG. 4, in the first embodiment, power consumption is 600 W for thick cloth, the difference of power consumption between thick cloth and thin cloth is ca. 120 W, and the moisture percentages of both cloths are 3%. In contrast to this, in Comparative Examples 1 and 2, when power consumption is the same, the drying efficiency of both-side dehydration is about 3% higher than that of one-side dehydration. This is because when suction is carried out only at one side of the dehydrating cylinder 11, the value of negative pressure decreases toward a side opposite to the suction side as the slit 12 is opened to the air and the suction efficiency of moisture is low whereas when suction is carried out at both sides of the dehydrating cylinder 11, the value of negative pressure decreases toward the center portion from both sides and hence, the length of a reduction in negative pressure is ½ that when suction is carried out at one side only, thereby increasing suction efficiency. When the power consumption of 750 W is used for both-side dehydration, the moisture content of thin cloth is 23% (moisture content of thin cloth after one-side dehydration is 26%) and that of thick cloth is 50% (moisture content of thick cloth after one-side dehydration is 53%). Therefore, it would be obvious that heating temperature and power consumption can be reduced by incorporating the electric heater 1 in the surface roller 14 as in the first embodiment to extend the length of cloth to be heated as much as possible and cloth can be thoroughly dried on the loom.

Second Embodiment

Figure 5A:
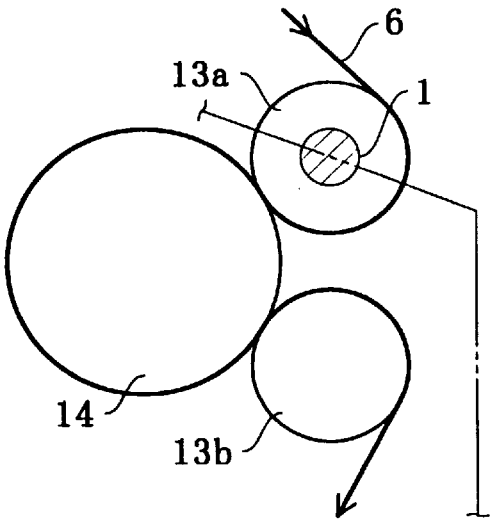
Figure 5B:
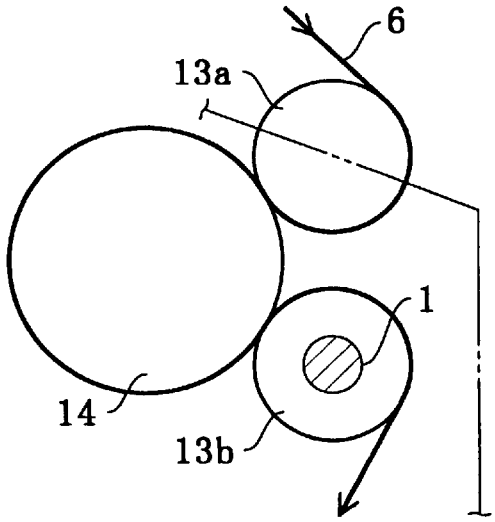

In the first embodiment, the electric heater 1 is incorporated in the surface roller 14. In this second embodiment, the electric heater 1 is incorporated in the upper press roller 13*a* as shown in FIG. 5*a*, in the lower press roller 13*b* as shown in FIG. 5*b*, or, not shown, in both of the press rollers 13*a*, 13*b*. Not shown, the electric heater 1 may be incorporated in all of the plurality of cloth winding rollers A.

Third Embodiment

In the first embodiment, the electric heater 1 is arranged on one side of the heater stay 22. In this third embodiment, a heat resistant electric insulating member 57 like a steatite pipe is fitted onto the heater stay 22, and the electric heater 1 made of a belt-like electric resistant wire is wound spirally round the insulating member 57 at predetermined intervals in an axial direction as shown in FIG. 6. Since the electric heater 1 is arranged around the heater stay 22 uniformly in such a manner that it is electrically insulated, the electric heater 1 is located in the center of the roller B (any one, two or all of the surface roller 14 and the press rollers 13*a*, 13*b* of the first embodiment) which incorporates the electric heater 1 out of the plurality of cloth winding rollers A (see FIG. 1). Thereby, the reach distance of heat radiated from the electric heater 1 toward the outer peripheral surface of the roller B becomes the same and cloth 6 is dried uniformly along its entire width.

Fourth Embodiment

In the first embodiment, the blow-off unit 2 which makes use of exhaust air from the blower 18 is provided as moisture condensation preventing means. In this fourth embodiment, as shown in FIG. 7, the width of a cover 52 as moisture condensation preventing means in the horizontal direction of the loom is made larger than the maximum weaving width and formed like a belt-like plate when seen from above the loom so that the cloth 6 around the surface roller 14 is hidden behind the cover 52. A lower end portion of the cover 52 is brought into contact with the under surface of the top stay 39 and fastened by a bolt and nut 41. An intermediate portion of the cover 52 is bent obliquely upward and extended substantially in parallel to the water shielding plate 40 with a gap 53 therebetween, and further a gap 54 is formed between the dehydrating cylinder 11 and the cover 52. A top end portion 52*a* of the cover 52 lies between the dehydrating cylinder 11 and the press roller 13*a* and is located on the press roller 13*a* side rather than the dehydrating cylinder 11 side, that is, at the front of the loom. The cover 52 may be made of a metal, resin or the like. The cover 52 may be reinforced with beads or reinforcement to prevent its top end portion 52*a* from contacting the dehydrating cylinder 11 and the press rollers 13 when it is shaken by the vibration of the loom.

According to the constitution of this fourth embodiment, the cloth dryer operates as follows. Even when vapor from the cloth 6 goes up, as there are the gaps 53 and 54 between the cover 52 and the water shielding plate 40 and between the cover 52 and the dehydrating cylinder 11, respectively, air layers in the gaps 53, 54 function as a heat insulator so that the cover 52 is rarely cooled by radiation heat from the dehydrating cylinder 11 and the water shielding plate 40 and maintained substantially at room temperature. Therefore, even when the vapor is contacted to the cover 52 to be cooled, moisture condensation rarely occurs on the surface of the cover 52. Consequently, a water drop rarely falls on the cloth 6 on the surface roller 14. When the cover 52 is inclined downward to the top stay 39 from the dehydrating cylinder 11 between the dehydrating cylinder 11 and the top stay 39, even if the vapor is condensed on the under surface of the cover 52, the condensed water runs toward the rear of the loom along the cover 52 and reaches the lower end of the top stay 39. Therefore, a water drop does not fall on the cloth 6 on the surface roller 14. If the vapor condenses on the under surface of the water shielding plate 40 through the gaps 53, 54 and a water drop falls from the water shielding plate 40, the water drop is received by the cover 52, runs over the top of the cover 52 and is guided and exhausted to the outside of the loom by an unshown water guide body provided on the inner walls of the right and left side frames 20, 21 from the end portion of the cover 52.

Fifth Embodiment

In the fourth embodiment, the cover 52 is provided as moisture condensation preventing means with the gaps 53, 54 formed between it and the water shielding plate 40 and between it and the dehydrating cylinder 11, respectively. In this fifth embodiment, as shown in FIG. 8, a water absorptive member 56 such as water absorptive tape is laid on the under surface of the water shielding plate 40 as moisture condensation preventing means, water condensed on the dehydrating cylinder 11 is caught by a water absorbing layer 56*a* formed on the water shielding plate 40 side of the water absorptive member 56, and the water is diffused into the inside of the water absorbing layer 56*a* by the capillary phenomenon of the water absorbing layer 56*a* and evaporated with heat rising from the surface roller 14. That is, moisture is caught by the water absorptive member 56 to prevent weft insertion water from contacting the water shielding plate 40 directly. Thereby, the cooling of the water shielding plate 40 is restricted to prevent moisture condensation. A surface layer 56*b* on the surface roller 14 side of the water absorptive member 56 may be made of a material which is free from moisture condensation, such as Teflon.

Sixth Embodiment

In the fifth embodiment, the water absorptive member 56 as moisture condensation preventing means is provided on the under surface of the water shielding plate 40. In this sixth embodiment, not shown, the water absorptive member 56 is provided on the under surface of the cover 52 of the third embodiment. In this case, the same function and effect as those of the third embodiment can be obtained.

Seventh Embodiment

In the first embodiment, the distribution of heat input into the surface roller 14 from the electric heater 1 is not specified. In this seventh embodiment, as shown in FIG. 9, the amount of heat input into the surface roller 14 from the electric heater 1 is larger at the both end portions than the center portion in a width direction of the cloth so that the cloth 6 can be uniformly dried in the width direction. In the dehydrating cylinder 11 of FIG. 2, the both end portions of the cloth 6 pass over the outer side in an axial direction of the slit 12 and covers the slit 12 completely, thereby preventing the outside air from being sucked into the inside of the dehydrating cylinder 11 from gaps between the both end portions of the cloth 6 and the both end portions of the slit 12 to eliminate a reduction in the suction force of the dehydrating cylinder 11 for the cloth 6. Therefore, the cloth 6 which contains more moisture in the both end portions on the outer side in an axial direction of the slit 12 than in the center portion reaches heating and drying elements consisting of the press rollers 13*a*, 13*b* and the surface roller 14 incorporating the electric heater 1. Since the amount of heat input into the surface roller 14 from the electric heater 1 is made larger at the both end portions of the cloth 6 than at the center portion of the cloth 6, the both end portions of the cloth 6 containing more moisture than the center portion are dried to the same degree as that of the center portion by the high-temperature both end portions of the surface roller 14, the heating temperature of the electric heater 1 and the power consumption are reduced, and the cloth 6 can be uniformly dried in the width direction of the cloth by the above heating and drying elements.

In this seventh embodiment, to achieve the uniform heat distribution of the surface roller 14, the coil pitch P1 at the center portion (an area denoted by "a" in FIG. 9) of the electric heater 1 which is formed like a coil is made larger than the coil pitch P2 at the both end portions (areas denoted by "b" in FIG. 9). The results of experiments on this heat distribution will be described below. When an electric heater having the same coil pitch in the entire width direction of the cloth was incorporated into the surface roller 14 as a comparative example, electricity was applied to the electric heater and the surface temperature of the surface roller 14 was measured, the temperature was 10° C. higher at the both end portions than the center portion. In contrast to this, when an electric heater having P1 larger than P2 as in the seventh embodiment was incorporated into the surface roller 14, electricity was applied to the electric heater and the surface temperature of the surface roller 14 was measured, the temperature at the center portion and the temperature at the both end portions of the surface roller 14 could be properly controlled such that there was no difference in temperature between the both end portions and the center portion, or the temperature at the both end portions was 1 to 2° C. higher or lower than the temperature at the center portion, which might depend on the proportion of the center portion to the both end portions of the electric heater or the proportion of the coil pitches.

The electric heater 1 is a single coiled wire material formed by folding into two in a length direction a heater wire material prepared by coating an electric resistance heat generating wire such as a nichrome wire with an insulating material such as silicon rubber. Since, at one coiled end of the electric heater 1, two cables 62 connected to an end portion of the heater wire material are extended to the outside of the surface roller 14 from a through hole 25*a* in the roller shaft 25 and connected to the heater power switch 1*a*, connection between the electric heater 1 and the heater power switch 1*a* is carried out easily at one of the side frames 20, 21 which are arranged to face each other. In the inside of the surface roller 14, the electric heater 1 suspended by the heater stay 22 which is inserted into the inside of the coiled electric heater 1 is fixed by unshown clips at several sites out of a large number of contact portions between the electric heater 1 and the heater stay 22 so that the electric heater 1 does not move in the axial direction of the roller. Since the thermal expansion of this coiled electric heater 1 during its heat generation occurs in a radial direction of the coil, the material having heat resistance like a metal. Since the temperature sensor 3 is located away from the electric heater 1 inside the surface roller 14, it can detect the temperature of air inside the surface roller 14 heated by the electric heater 1 accurately. Since the cable 63 of the temperature sensor 3 is extended to the outside of the surface roller 14 from the through hole 25*a* like the cable 62 and connected to the comparator 4, cables connecting the heater power switch 1*a*, the comparator 4 and the temperature controller 5 can be collected at one site.

Eighth Embodiment

In the first embodiment, the roller shafts 24, 25 are simply connected to the end portions of the surface roller 14. In this eighth embodiment, as shown in FIG. 10, an air pool 64 is formed at both end portions of the surface roller 14 to increase the heat retaining property of the end portions of the surface roller 14 so that the cloth 6 can be uniformly dried in the width direction of the cloth. In this eighth embodiment, the air pool 64 is formed in connection portions between the roller shafts 24, 25 and the both end portions of the surface roller 14. FIG. 10 shows the air pool 64 formed in the connection portion between one end portion of the surface roller 14 and the roller shaft 24. A ring-shaped dam 65 is provided on the inner wall of the surface roller 14, a bolt 26 is fastened to the dam 65 from the outside of a large diameter portion of the roller shaft 24 while the large diameter portion is abutted against the end portion of the surface roller 14, and the roller shaft 24 is fixed to the end portion of the surface roller 14, whereby the air pool 64 is formed between the dam 65 and the large diameter portion of the roller shaft 24. Therefore, the air pool 64 contains the inside air of the surface roller 14 heated by the electric heater 1 and the end portion of the surface roller 14 is heated by hot air in the air pool 64, thereby making it possible to dry the cloth 6 uniformly in the width direction of the cloth while reducing the heating temperature of the electric heater 1 and the amount of power consumption. It is easily understood that an air pool identical to the air pool 65 can be formed in the connection portion between the other end portion of the surface roller 14 and the roller shaft 25 by providing a dam identical to the above dam 65 at the other end portion of the surface roller 14, fastening a bolt 27 to the dam from the outside of a large diameter portion of the roller shaft 25 while the large diameter portion is abutted against the other end portion of the surface roller 14, and fixing the roller shaft 25 to the other end portion of the surface roller 14.

Ninth Embodiment

In the first embodiment, the cloth roller 7 is provided between the side frames 20, 21 of the loom. In this ninth embodiment, as shown in FIG. 11, the cloth roller 7 is installed in a take-up machine 70 which is arranged in front of the loom and separate from the side frames 20, 21. In this loom, the electric heater 1 is incorporated in a reverse roller 68 out of a plurality of cloth winding rollers D consisting of a push roller 67 and the reverse roller 68 which are located below the cloth winding rollers A consisting of the press rollers 13*a*, 13*b* and the surface roller 14 and attached to the side frames 20, 21 so that the cloth 6 can be uniformly dried.

In this ninth embodiment, the electric heater 1 is housed substantially in the center portion of the interior of the reverse roller 68 in such a manner that it is suspended in the entire width direction of the cloth 6 to be wound round the reverse roller 68. The electric heater 1 generates heat with electricity supplied from the unshown power source according to the feedback control of the temperature sensor 3, the comparator 4, the temperature controller 5 and the temperature setting unit 60 and heats the entire peripheral surface of the reverse roller 68 of FIG. 11 uniformly and efficiently.

Since the push roller 67 is in pressure contact with this reverse roller 68 heated by the electric heater 1 by a spring 69, the whole push roller 67 is heated uniformly with heat transmitted from the reverse roller 68. The cloth 6 woven of the warp 9 which reaches the heald 10 from the warp beam 8 through the guide roller 45 and the unshown weft inserted by opening and closing by the heald 10 of FIG. 1, inserting the weft from the weft insertion nozzle and beating up with an unshown reed is dehydrated by the dehydrating cylinder 11, passes over the press roller 13*a*, the surface roller 14 and the press roller 13*b* and then over the plurality of cloth winding rollers D in such a manner that it travels substantially ⅓ round the push roller 67, passes through the contact plane between the push roller 67 and the reverse roller 68, and goes substantially half round the reverse roller 68. Therefore, the length of the cloth 6 heated is equal to the total distance of ⅓ the circumference of the push roller 67 and ½ the circumference of the reverse roller 68 and extremely long, thereby making it possible to reduce the heating temperature of the electric heater 1. After the cloth 6 passes over the guide roller 71 and the drive roller 72 of the cloth take-up machine 70 from the reverse roller 68, it passes between the drive roller 72 and the cloth roller 7 and between a slave roller 73 and the cloth roller 7 and is taken up by the cloth roller 7. Reference numeral 74 in FIG. 11 denotes a working bench arranged in a working space between the side frames 20, 21 and the cloth take-up machine 70 of the loom. When an operator steps on the working bench 74 to work in the working space, the cloth 6 between the reverse roller 68 and the guide roller 71 can be protected.

Tenth Embodiment

In the first embodiment, the electric heater 1 is fixed to the heater stay 22 by a plurality of heater brackets 23. In this tenth embodiment, as shown in FIGS. 12(*a*) and 12(*b*), the electric heater 1 is connected to the heater stay 22 by the heater brackets 23 in such a manner that it can move in the axial direction of the roller so that the bad influence of the elongation of the rod-shaped electric heater 1 can be avoided. In this tenth embodiment, all the plurality of heater brackets 23 may be movably attached to either one of the electric heater 1 and the heater stay 22. When one heater bracket 23 at one end portion is fixed to the heater stay 22 and other heater brackets 23 are movably attached to the heater stay 22, the bad influence of the elongation of the electric heater 1 such as curvature or breakage of the electric heater 1 can be avoided without a big change in the position of the electric heater 1 relative to the heater stay 22.

FIG. 12 shows one heater bracket 23 for movably connecting the electric heater 1 to the heater stay 22. This heater bracket 23 consists of two symmetrical bracket elements which are combined to face each other with a bolt and nut 75, upper clip portions 23*a* thereof are attached to the heater stay 22 in such a manner that they are prevented from falling off by the heater stay 22 and can be moved in an axial direction of the heater stay 22, and lower clip portions 23*b* thereof firmly support the end portion of the electric heater 1 while they give the electric heater 1 an elastic function in an inward direction with the two bracket elements. Since the upper clip portions 23*a* move with respect to the heater stay 22 by the elongation of the electric heater 1 even when the rod-shaped electric heater 1 elongates linearly, such inconvenience that the electric heater 1 is bent or broken can be eliminated.

A cable 77 which is a sheathed cable and connected to the electric heater 1 through a terminal 76 is movably connected to the heater stay 22 by a cable bracket 78. The cable bracket 78 has a double structure consisting of an outer tube 78*a* made from a material having thermal retraction such as silicon and an inner tube 78*b* made from a material having lubricity with a sheathing material of the cable 77 such as Teflon (registered trademark). While the heater stay 22 is inserted between the outer tube 78*a* and the inner tube 78*b*, the outer tube 78*a* shrinks with heat and supports the inner tube 78*b* such that it does not move with respect to the cable 77 and the heater stay 22, and the inner tube 78*b* supports the cable 77 in such a manner that the cable 77 can move with respect to the heater stay 22. Therefore, when the electric heater 1 elongates with heat generated therefrom, the heater bracket 23 slides over the cable 77 and the inner tube 78*b* thereby slides over the outer tube 78*a*. As a result, electrical connection can be well maintained for a long time without a load on the connection portion between the terminal 76 and the cable 77.

Eleventh Embodiment

In the tenth embodiment, the bad influence of the elongation of the electric heater 1 on the connection portion between the terminal 76 and the cable 77 is avoided by movably connecting the cable 77 to the heater stay 22 by the cable bracket 78. In this eleventh embodiment, as shown in FIG. 13(*a*) or 13(*b*), part of the cable 77 is curved to avoid the bad influence of the elongation of the electric heater 1. In FIG. 13(*a*), as the cable 77 is fixed to the heater stay 22 by the heater bracket 79 and part of the cable 77 between the heater bracket 79 and the terminal 76 is curved like U, when the electric heater 1 elongates, the U-shaped curve portion 77*a* is deformed as shown by a dotted line from a position shown by a solid line, thereby making it possible to avoid the bad influence. In FIG. 13(*b*), as part of the cable 77 between the heater bracket 79 and the terminal 76 is curved like a loop, when the electric heater 1 elongates, the looped curve portion 77*b* is deformed as shown by a dotted line from a position shown by a solid line, thereby making it possible to avoid the bad influence.

Twelfth Embodiment

In the tenth embodiment, the electric heater 1 is connected to the heater stay 22 by the heater brackets 23 in such a manner that it can move in the axial direction of the roller to avoid the bad influence of the elongation of the rod-shaped electric heater 1. In this twelfth embodiment, as shown in FIG. 14, the rod-shaped electric heater 1 is fixed to the heater stay 22 by the heater brackets 23 in a such a manner that it is folded into two in a length direction of the heater 1, whereby even when the rod-shaped electric heater 1 elongates linearly, a folded portion 1*b* displaces from a position shown by a solid line to a position shown by a dotted line, thereby making it possible to absorb the elongation of the electric heater 1. Therefore, such inconvenience that the electric heater 1 is bent or broken can be eliminated.

Thirteenth Embodiment

In the seventh embodiment, the coil pitch P1 of the center portion of the electric heater 1 is made large and the coil pitch P2 of the both end portions of the electric heater 1 is made small to make the amount of heat input into the surface roller 14 from the electric heater 1 larger at the both end portions than the center portion in the width direction of the cloth so that the cloth 6 can be uniformly dried in the width direction of the cloth. In this thirteenth embodiment, as shown in FIG. 15, the coiled electric heater 1 consists of a first electric heater 1*c* encircled by a virtual line frame "c", a second electric heater 1*d* encircled by a virtual line frame "d" and a third electric heater 1*e* encircled by a virtual line frame "e" and the amount of power consumption can be reduced properly according to the width of the cloth to be woven. In this thirteenth embodiment, the first to third electric heaters 1*c* to 1*e* are arranged inside the surface roller 14 from the weft insertion side to its opposite side. The coil pitch P3 of a portion "f" on a side opposite to the weft insertion side of the first electric heater 1*c* is large and the coil pitch P4 at a portion "g" on the weft insertion side of the first electric heater 1*c* is small (P3>P4). The coil pitch of the second electric heater 1*d* is set as large as the coil pitch P3 of the first electric heater 1*c*. The coil pitch of the third electric heater 1*e* is set as small as the coil pitch P4 of the first electric heater 1*c*. A heater power switch identical to the heater power switch 1*a* of the first embodiment consists of a first heater power switch 1*f*, a second heater power switch 1*g* and a third heater power switch 1*h* corresponding to the first to third electric heaters 1*c* to 1*e*. The first heater power switch 1*f* is connected to the first electric heater 1*c*, the second heater power switch 1*g* is connected to the second electric heater 1*d*, and the third heater power switch 1*h* is connected to the third electric heater 1*e*. When the first heater power switch 1*f* is turned on, the first electric heater 1*c* generates heat with electricity supplied from the unshown power source according to the feedback control of the temperature sensor 3, the comparator 4 and the temperature controller 5 of FIG. 1. When the second heater power switch 1*g* is turned on, the second electric heater 1*d* generates heat with electricity supplied from the unshown power source according to the feedback control of the temperature sensor 3, the comparator 4 and the temperature controller 5 of FIG. 1. When the third heater power switch 1*h* is turned on, the third electric heater 1*e* generates heat with electricity supplied from the unshown power source according to the feedback control of the temperature sensor 3, the comparator 4 and the temperature controller 5 of FIG. 1. For instance, when the width of the cloth 6 is as small as the width of the first electric heater 1*c*, the first heater power switch 1*f* is turned on, the second heater power switch 1*g* and the third heater power switch 1*h* are turned off. When the width of the cloth is smaller than the total width of the first electric heater 1*c* and the second electric heater 1*d*, the first heater power switch 1*f* and the second heater power switch 1*g* are turned on and the third heater power switch 1*h* is turned off. When the width of the cloth is larger than the total width of the first electric heater 1*c* and the second electric heater 1*d*, the first to third heater power switches 1*f* to 1*h* are turned on. Thus, the amount of power consumption can be reduced properly according to the width of the cloth to be woven.

Fourteenth Embodiment

In the first embodiment, the heater power switch 1*a* is turned off when the operation of the loom is stopped. In this fourteenth embodiment, as shown in FIG. 16, the temperature set by the temperature setting unit 60 is changed to a predetermined temperature higher than room temperature and lower than the set temperature during the operation of the loom while the heater power switch 1*a* (see FIG. 1) is kept on during the suspension of the loom so that the surface temperature of the surface roller 14 (see FIG. 1) is kept at 30° C. which does not influence the cloth 6, thereby making it possible to shorten a temperature rise time after the suspension of the loom. In this fourteenth embodiment, a period from a time t1 to a time t2 is a temperature rise time during which the surface temperature of the surface roller 14 rises to the set temperature with heat generated from the electric heater 1 after the heater power switch 1*a* is turned on by the start of operation. When the operation of the loom is stopped by a weft insertion failure or the like at a time t3 after the operation of the loom is started at the time t2, the set temperature is automatically changed to the predetermined temperature by the temperature controller 5 in response to a loom operation stop signal, whereby the amount of heat generated by the electric heater 1 decreases and the surface temperature of the surface roller 14 falls down to the predetermined temperature. Thereafter, when the cause of stopping the operation of the loom is eliminated and the operator turns on the operation start switch of the loom for restarting the loom at a time t4, the predetermined temperature is automatically changed to the set temperature by the temperature controller 5 in response to the ON operation signal of the operation start switch, whereby the amount of heat generated by the electric heater 1 increases and the surface temperature of the surface roller 14 rises to the set temperature. When the surface temperature of the surface roller 14 reaches the set temperature at a time t5, the operation of the loom is restarted. Thus, during the suspension of the loom from the time when the operation of the loom is stopped by a weft insertion failure or the like during the operation of the loom to the time when the operator eliminates the cause of the stoppage, the electric heater 1 generates heat having a temperature lower than the temperature during operation but higher than room temperature to preheat the surface roller 14, thereby making it possible to increase the surface temperature of the surface roller 14 to the set temperature in a short period of time when the operation of the loom is restarted after the cause of the suspension is eliminated. Means of controlling preheating temperature to a temperature lower than drying temperature in response to a loom stop signal, which is included in the heating means of the fourteenth embodiment, is incorporated in the loom controller C of FIG. 1.

Fifteenth Embodiment

In the seventh embodiment, to make the amount of heat input into the surface roller 14 from the electric heater 1 larger at the end portions than the center portion in a width direction of the cloth, the coil pitch of the coiled electric heater 1 is changed. When the rod-shaped electric heater 1 of FIG. 1 is a far infrared or sheathed type electric heater, a resistance heat generating element which is the core of the electric heater is coiled and the coil pitches thereof are set to P1 and P2 of FIG. 9, thereby making it possible to achieve the same effect as that of the seventh embodiment.

As described above, according to the present invention, firstly, since heating means is incorporated in one of cloth winding rollers which let off cloth woven by the loom to the cross roller side in such a manner that the cloth travels round one roller through pressure contact portions among a plurality of cloth winding rollers which are in pressure contact with one another, heat is transmitted to rollers in pressure contact with the roller incorporating the heating means so that the cloth can be heated in a wide range. Therefore, the temperature transmitted from the roller to the cloth can be reduced to a low temperature which has no bad influence on the cloth. Consequently, even when cloth having a large water content such as thick cloth is woven by a loom which operates at a high speed, the cloth can be thoroughly dried. A bulky dryer which is used in a post-step is not required, and the quality of cloth can be maintained, and electric power consumption can be reduced with an inexpensive apparatus.

Secondly, since the heating means is located in the center or in the vicinity of the center of the roller, the entire roller can be uniformly and efficiently heated.

Thirdly, since the roller incorporating the heating means is a surface roller which is a drive roller having a large diameter supported by the right and left side frames of the water jet loom, the cloth is kept in contact with the surface roller having the highest temperature out of the plurality of cloth winding rollers for a long time without impairing operationability which occurs at the time of exchanging a warp beam, thereby further improving drying efficiency, as compared with the press roller for moving a support portion at the time of exchanging the apparatus.

Fourthly, since moisture condensation preventing means for preventing moisture condensation on the upper peripheral members is provided above the roller incorporating the heating means, a water drop is prevented from falling on the cloth on the plurality of cloth winding rollers, and drying nonuniformity between portions which have got wet with dropping water and other portions of the cloth after the cloth winding rollers is prevented, thereby making it possible to maintain the quality of the cloth.

Fifthly, since the moisture condensation preventing means is located in space above the roller incorporating the heating means and generates an air flow going toward the width direction of the cloth, the structure of the moisture condensation preventing means can be simplified.

Sixthly, since the amount of heat input into the roller from the heating means is made larger at the end portions than the center portion in a width direction of the cloth, the temperature at the center portion and the temperature at the end portions of the surface roller can be properly controlled so that the difference of temperature between the center portion and the end portions of the surface roller is reduced. Even when the end portions of the cloth contain more moisture than the center portion thereof, the end portions of the cloth are dried to the same degree as the center portion at the high-temperature end portions of the surface roller, whereby the cloth can be uniformly dried in the width direction of the cloth.

Seventhly, since the heating means is a coiled electric heater which is supported by a rod member extending in the axial direction of the roller, the elongation of the electric heater during heat generation occurs in the radial direction of the coil, and such inconvenience that the electric heater is broken at support points between the electric heater and the rod member can be eliminated. Further, the support of the electric heater by the rod member can be simplified.

Eighthly, since the heating means comprises means of controlling preheating temperature to a temperature lower than drying temperature in response to a loom stop signal, the surface temperature of the surface roller can be increased to the set temperature in a short period of time when the operation of the loom is restarted.

What is claimed is:

1. A cloth dryer for a water jet loom which thermally dries moisture contained in cloth by bringing a roller incorporating heating means into contact with the cloth woven by the loom, wherein the woven cloth passes through pressure contact portions among a plurality of cloth winding rollers which are in pressure contact with one another and is wound off to a cloth roller side from at least one roller which the cloth is wound round out of the plurality of cloth winding rollers, and the heating means is incorporated in at least one roller out of the plurality of cloth winding rollers.

2. The cloth dryer for a water jet loom of claim 1, wherein the heating means is located in the center or in the vicinity of the center of the roller.

3. The cloth dryer for a water jet loom of claim 1, wherein the roller incorporating the heating means is a surface roller which is rotated supported by right and left side frames of the water jet loom.

4. The cloth dryer for a water jet loom of claim 1, wherein moisture condensation preventing means for preventing moisture condensation on upper peripheral members is provided above the roller incorporating the heating means.

5. The cloth dryer for a water jet loom of claim 4, wherein the moisture condensation means is means, located in space above the roller incorporating the heating means, for generating an air flow going toward the width direction of the cloth.

6. The cloth dryer for a water jet loom of claim 1, wherein the amount of heat input into the roller from the heating means is made larger at the end portions than the center portion in a width direction of the cloth.

7. The cloth dryer for a water jet loom of claim 1, wherein the heating means is a coiled electric heater supported by a rod member extending in an axial direction of the roller.

8. The cloth dryer for a water jet loom of claim 1, wherein the heating means comprises means of controlling preheating temperature to a temperature lower than drying temperature in response to a loom stop signal.

* * * * *